US009731924B2

(12) United States Patent
Allen, Jr. et al.

(10) Patent No.: US 9,731,924 B2
(45) Date of Patent: Aug. 15, 2017

(54) SHEET STACKING APPARATUS HAVING ADJUSTABLE LENGTH CONVEYOR SECTION

(71) Applicant: A. G. Stacker, Inc., Weyers Cave, VA (US)

(72) Inventors: Clarence C. Allen, Jr., Mt. Crawford, VA (US); Eric H. Crowe, Weyers Cave, VA (US); Micah C. Sundstrom, Staunton, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 0 days.

(21) Appl. No.: 15/235,592

(22) Filed: Aug. 12, 2016

(65) Prior Publication Data

US 2017/0043956 A1 Feb. 16, 2017

Related U.S. Application Data

(60) Provisional application No. 62/204,091, filed on Aug. 12, 2015.

(51) Int. Cl.

| | |
|---|---|
| ***B65G 15/26*** | (2006.01) |
| ***B65G 17/28*** | (2006.01) |
| ***B65G 21/14*** | (2006.01) |
| ***B65H 29/16*** | (2006.01) |
| ***B65H 29/60*** | (2006.01) |

(Continued)

(52) U.S. Cl.

CPC ..... *B65H 29/16* (2013.01); *B65H 29/18* (2013.01); *B65H 29/50* (2013.01); *B65H 29/60* (2013.01); *B65H 43/00* (2013.01); *B65H 2301/4473* (2013.01); *B65H 2404/255* (2013.01); *B65H 2404/2691* (2013.01); *B65H 2404/2693* (2013.01); *B65H 2701/1762* (2013.01)

(58) Field of Classification Search

CPC ..... B65G 57/112; B65H 29/50

USPC ..... 198/594, 592, 861.5; 414/794.5, 794.6; 271/201

See application file for complete search history.

(56) References Cited

U.S. PATENT DOCUMENTS 2,660,432 A * 11/1953 Wilske ..... B65H 29/50 198/592

3,321,202 A * 5/1967 Martin ..... B65H 29/16 271/198

(Continued)

*Primary Examiner* — William R Harp

(74) *Attorney, Agent, or Firm* — J-Tek Law PLLC; Jeffrey D. Tekanic; Scott T. Wakeman

(57) ABSTRACT

A sheet stacking system for transporting sheets and depositing them in a stack includes a layboy, a transport conveyor downstream of the layboy, and a main conveyor downstream of the transport conveyor, the main conveyor having a frame and being supported by a conveyor support, a discharge end of the main conveyor being movable between a lowered position and a raised position relative to the conveyor support. The main conveyor intake end is configured to move from a first position when the main conveyor discharge end is in the lowered position to a second position when the main conveyor discharge end is in the raised position, and also a variable length conveyor between the transport conveyor and the main conveyor, the variable length conveyor having a discharge end connected to and movable with the main conveyor intake end and movable relative to the transport conveyor discharge end.

18 Claims, 10 Drawing Sheets

(51) Int. Cl.

| | |
|---|---|
| ***B65H 43/00*** | (2006.01) |
| ***B65H 29/18*** | (2006.01) |
| ***B65H 29/50*** | (2006.01) |

(56) References Cited

U.S. PATENT DOCUMENTS

| | | | | |
|---|---|---|---|---|
| 3,419,266 | A * | 12/1968 | Martin | B65H 29/50 271/189 |
| 4,065,122 | A * | 12/1977 | Rejai | B65H 29/50 187/369 |
| 5,904,465 | A * | 5/1999 | Villacieros Fernandez | B65H 29/18 271/182 |
| 7,404,556 | B2 * | 7/2008 | Allen, Jr. | B65H 31/10 198/836.1 |
| 7,753,357 | B2 * | 7/2010 | Allen, Jr. | B65H 29/16 271/198 |
| 7,954,628 | B2 * | 6/2011 | Allen, Jr. | B65G 51/32 198/592 |

* cited by examiner

SHEET STACKING APPARATUS HAVING ADJUSTABLE LENGTH CONVEYOR SECTION

CROSS-REFERENCE TO RELATED APPLICATIONS

The present application claims the benefit of U.S. provisional patent application No. 62/204,091, filed Aug. 12, 2015, the entire contents of which is hereby incorporated by reference.

FIELD OF THE INVENTION

The present invention is directed to a stacking apparatus having a tiltable main conveyor and a fixed transfer conveyor and an adjustable length conveyor between the main conveyor and the transfer conveyor, and, more specifically, to a stacking apparatus having a main conveyor with an intake end that moves laterally relative to a portion of a transfer conveyor when a discharge end of the main conveyor rises and an adjustable length conveyor between the main conveyor and the transfer conveyor that lengthens as the main conveyor moves away from the transfer conveyor.

BACKGROUND OF THE INVENTION

Devices for stacking generally planar articles of material, such as sheets of corrugated material, are well known. One example of a commercially available device is the AGS2000 Rotary Die Cut Stacker made by the assignee of the present invention, A.G. Machine, Inc., Weyers Cave, Va. Further examples of such devices are disclosed in U.S. Pat. No. 3,321,202 to Geo. M. Martin and U.S. Pat. No. 3,419,266 to Geo. M. Martin, each of which is expressly incorporated herein by reference in its entirety.

FIGS. 1-3 illustrate a conventional apparatus for stacking sheets. The stacking apparatus 100 generally comprises a layboy section 102 which receives sheets, such as corrugated blanks produced by a rotary die cut machine 103, and discharges the sheets onto a transfer conveyor 104. The transfer conveyor 104 receives the sheets and transports them to a main conveyor 106. The main conveyor 106 has an intake end 108 and a discharge end 110, and the transfer conveyor has an intake end 112 and a discharge end 114. At the main conveyor intake end 108, the main conveyor 106 is mounted to a base 116 at a pivot point 118 so that the main conveyor 106 may be pivoted to raise its discharge end 110. At the discharge end 110 of the main conveyor 106, an accumulator section 120 receives discharged sheets.

In operation, the main conveyor 106 is pivoted about the pivot point 118 to lower the discharge end 110 of the main conveyor 106 to an initial or lowered position, illustrated in FIG. 2. Sheets are fed onto the main conveyor 106 at its intake end 108, transported along the conveyor to its discharge end 110, and discharged from the conveyor toward a backstop 122 in the accumulator section 120. The sheets settle down, typically onto a discharge conveyor 132, to form a stack of sheets.

As additional sheets drop onto the stack, the main conveyor 106 is pivoted to raise the discharge end 110 thereof vertically so that the sheets are discharged above the top of the growing stack. If the pivot point 118 were laterally fixed, the discharge end 110 of main conveyor 106 would follow an arc about pivot point 118 and move laterally away from the stack as the discharge end 108 of the main conveyor 106 was raised. This would likely interfere with the efficient formation of a stack of sheets. Therefore, the intake end 108 of the main conveyor 106 is supported by pivot arm 126 which pivots relative to base 116 and the main conveyor 106. This allows the discharge end 110 of the main conveyor 106 to move generally vertically instead of following an arc and causes the intake end 108 of the main conveyor 106 to move laterally toward the stack as the discharge end 110 of main conveyor 106 rises.

While this movement of the intake end 108 of the main conveyor 106 helps ensure proper stack formation, it also pulls the transfer conveyor 104 away from the layboy section 102 and creates a gap between intake end 112 of the transfer conveyor 104 and the layboy section 102. This problem has previously been addressed by providing slats 128 (illustrated in FIG. 3) extending from the discharge end of the layboy section 102 toward transfer conveyor 104. As the intake end 108 of the main conveyor 106 moves away from the layboy section 102, it moves the transfer conveyor 104 away from the layboy section 102 as well. However, the slats 128 span the gap between the layboy 102 and the transfer conveyor and prevent a gap from opening up as the transfer conveyor moves. This, in turn, helps ensure that product exiting the layboy section 102 will reach transfer conveyor 104.

The slats 128 partially address the problem discussed above. However, they are relatively narrow, and small products and/or scrap material still occasionally catches on the slats.

Another method for addressing this problem is shown and described in U.S. Pat. No. 7,753,357 assigned to the assignee of the present application, which is incorporated herein by reference. The '357 patent describes a transfer conveyor that has a first end connected to the main conveyor and a second end connected to the layboy section. A belt tensioning system is provided that allows the length of the transfer conveyor to change so that a gap is not created between the layboy section and the transfer conveyor when the main conveyor deck is raised.

This approach works well in certain environments. However, it is sometimes necessary or desirable to use a transfer conveyor (transfer deck or diverting conveyor) that must be fixed in the length (sheet transport) direction. In such cases, when the discharge end of the main conveyor rises, the intake end of the main conveyor pulls away from the stationary diverter/transfer deck and leaves a gap into which sheets of material may fall.

SUMMARY

This problem and others are addressed by embodiments of the present disclosure, a first aspect of which comprises a sheet stacking system for transporting sheets in a downstream direction and depositing the sheets in a stack, the system comprising a conveyor support, a layboy comprising opposed upper and lower conveyors configured to receive the sheets from a rotary die cut machine at a layboy intake end and output the sheets from a layboy discharge end, a transport conveyor downstream of the layboy and configured to receive the sheets from the layboy at a transfer conveyor intake end and output the sheets from a transfer conveyor discharge end, and a main conveyor downstream of the transport conveyor. The main conveyor comprises a frame and is supported by the conveyor support and has a main conveyor intake end and a main conveyor discharge end, and the main conveyor discharge end is movable between a lowered position and a raised position relative to the conveyor support. The main conveyor intake end is configured to move from a first position relative to the conveyor support when the main conveyor discharge end is in the lowered position to second position relative to the conveyor support when the main conveyor discharge end is in the raised position. The system also includes a variable length conveyor between the transport conveyor discharge end and the main conveyor intake end, the variable length conveyor having a variable length conveyor intake end and a variable length conveyor discharge end connected to and movable with the main conveyor intake end and movable relative to the transport conveyor discharge end.

Another aspect of the disclosure comprises a sheet stacking system for transporting sheets in a downstream direction and depositing the sheets in a stack, the system comprising a conveyor support, a transport conveyor having a transport conveyor intake end and a transport conveyor discharge end, the transport conveyor discharge end being fixed relative to the conveyor support, and a main conveyor downstream of the transport conveyor. The main conveyor comprises a frame and is supported by the conveyor support and has a main conveyor intake end and a main conveyor discharge end. The main conveyor discharge end is movable between a lowered position and a raised position, and the main conveyor intake end is configured to move from a first position relative to the conveyor support when the main conveyor discharge end is in the lowered position to second position relative to the conveyor support when the main conveyor discharge end is in the raised position. The system also includes a variable length conveyor between the transport conveyor discharge end and the main conveyor intake end, the variable length conveyor having a variable length conveyor intake end and a variable length conveyor discharge end connected to and movable with the main conveyor intake end and movable relative to the transport conveyor discharge end. The variable length conveyor includes a first wheel supported by the frame of the main conveyor, a second wheel fixed relative to the discharge end of the transport conveyor, a third wheel mounted at the end of an arm pivotably connected to the frame and at least one belt mounted on the first, second and third wheels.

A further aspect of the disclosure comprises a sheet stacking system for transporting sheets in a downstream direction and depositing the sheets in a stack, the system comprising a conveyor support, a layboy comprising opposed upper and lower conveyors configured to receive the sheets from a rotary die cut machine at a layboy intake end and output the sheets from a layboy discharge end, a transport conveyor downstream of the layboy and configured to receive the sheets from the layboy at a transfer conveyor intake end and output the sheets from a transfer conveyor discharge end, and a main conveyor downstream of the transport conveyor. The main conveyor comprises a frame and is supported by the conveyor support and has a main conveyor intake end and a main conveyor discharge end. The main conveyor discharge end is movable between a lowered position and a raised position, and the main conveyor intake end is configured to move from a first position relative to the conveyor support when the main conveyor discharge end is in the lowered position to second position relative to the conveyor support when the main conveyor discharge end is in the raised position. The system also includes variable gap spanning means between the transport conveyor discharge end and the main conveyor intake end for carrying sheets from the transport conveyor to the main conveyor as a distance between the discharge end of the transport conveyor and the intake end of the main conveyor changes.

DETAILED DESCRIPTION

Figure 4:
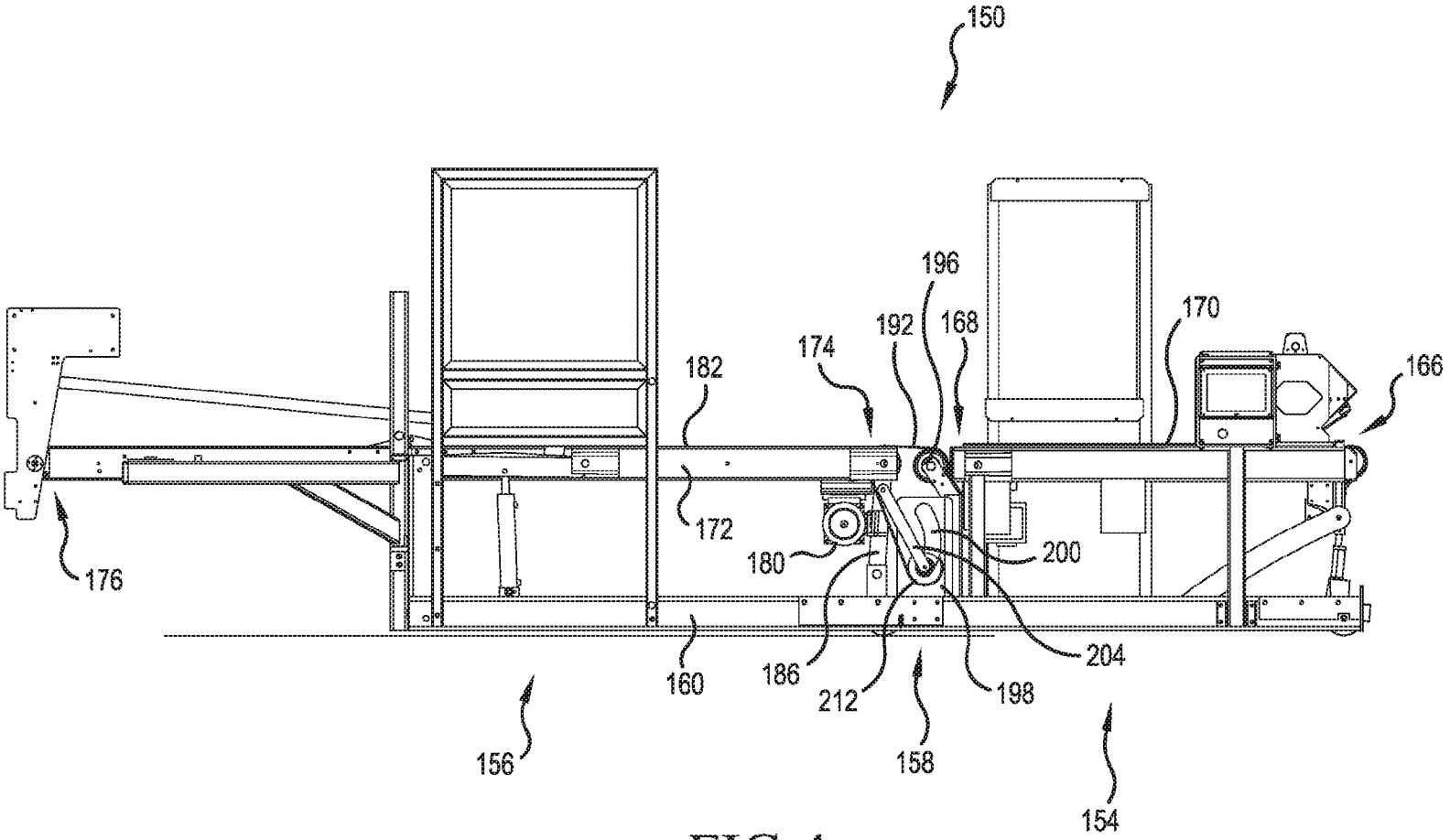
FIG. 4 is a side elevational view of a sheet stacking apparatus according to an embodiment of the present disclosure with a main conveyor in a horizontal or lowered position, a transfer conveyor and a gap conveyor between the main conveyor and the transfer conveyor.
Figure 6:
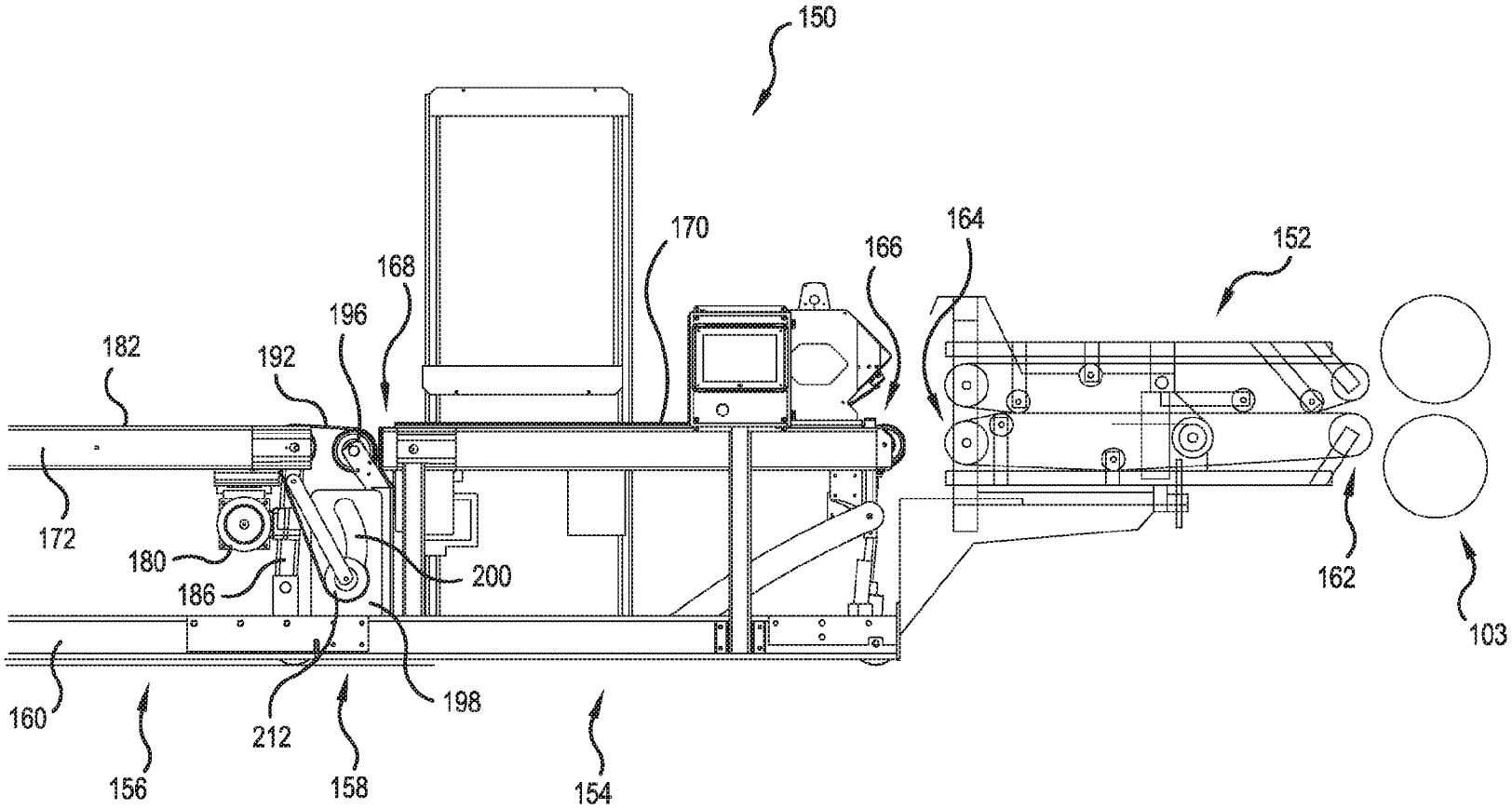
FIG. 6 is a side elevational view of a rotary die cut machine, a layboy, and a portion of the main conveyor of FIG. 4.

Referring now to the drawings, wherein the showings are for purposes of illustrating embodiments of the disclosure only and not for the purpose of limiting same, FIGS. 4 and 6 together show a stacking system 150 mounted next to the output of a rotary die cut machine 103. The stacking system includes a layboy 152, a transfer conveyor 154 downstream of the rotary die cut machine 103, and a main conveyor 156 downstream of the transfer conveyor 154. A variable length conveyor 158 is located between the transfer conveyor 154 and the main conveyor 156. At least the main conveyor 156 is attached to a conveyor support 160 that is in turn configured to rest on or be mounted on a floor or other surface. In the present embodiment, the transfer conveyor 154 and the layboy 152 are also be mounted on the conveyor support 160 (formed by joining individual support elements together) but each individual conveyor sections could alternately be mounted on separate supports that are located immediately adjacent to one another.

As used herein, the term "downstream" refers to the direction from the rotary die cut machine 103 to the main conveyor 156, the direction that sheets of material will travel along the stacking system 150 when it operates.

The layboy 152 is conventional and has an intake end 162 and a discharge end 164. It will not be described in detail herein.

The transfer conveyor 154 has an intake end 166 and a discharge end 168, and the discharge end 168 of the transfer conveyor 154 is fixed relative to the conveyor support 160. The transfer conveyor includes a plurality of belts 170, which form a support surface for carrying the sheets from the layboy 152 toward the main conveyor 156.

Figure 9:
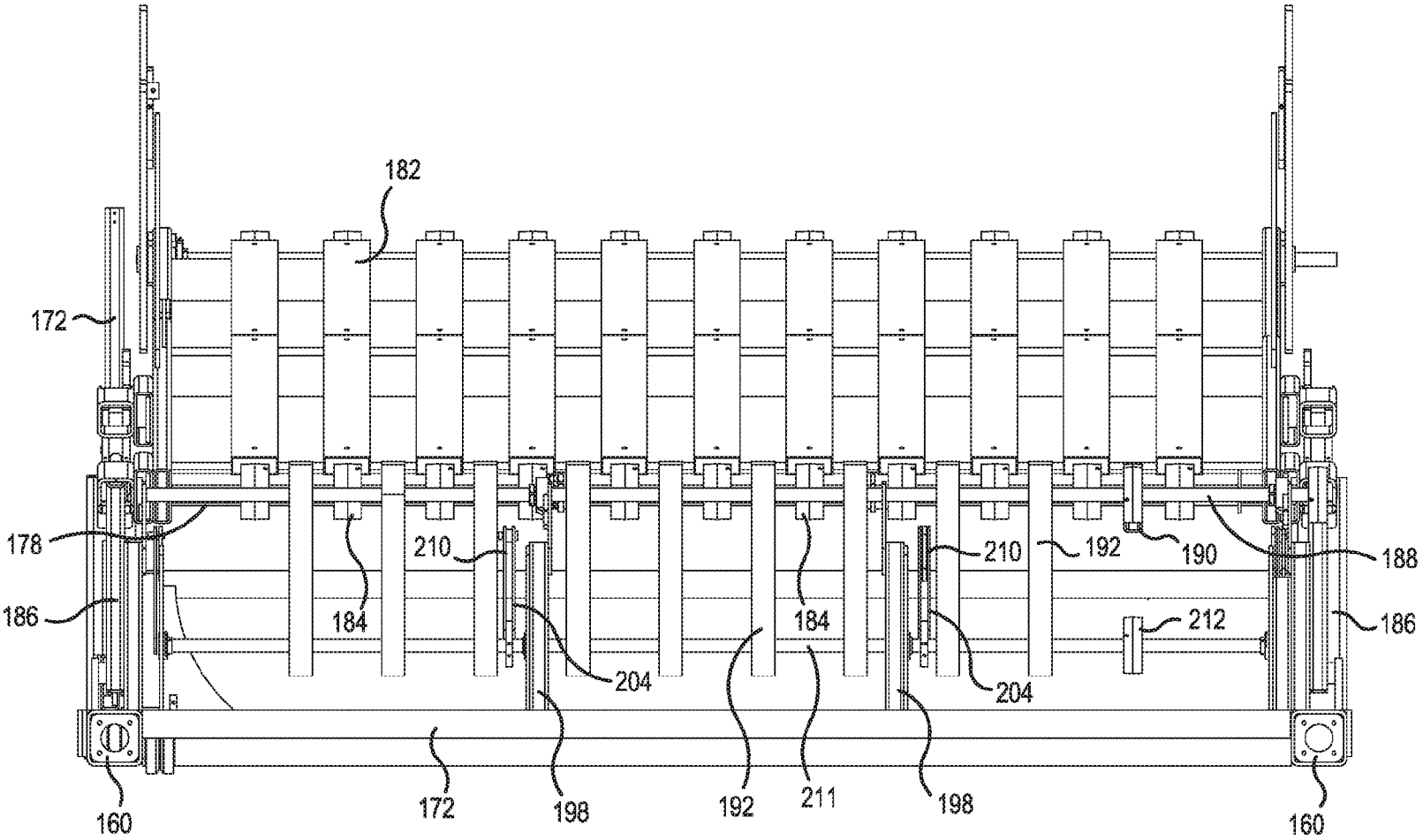
FIG. 9 is a front elevational view of the gap conveyor and the main conveyor.

The main conveyor 156 has a frame 172, an intake end 174 and a discharge end 176 from which sheets of material (not illustrated) fall to form a stack (not illustrated). The main conveyor 156 also includes a driveshaft 178 (FIGS. 9 and 10) near the intake end 174 and a drive 180 configured to rotate the driveshaft 178 to cause the top surfaces of a plurality of belts 182 of the main conveyor 156 to move in the downstream direction. The belts 182 are mounted on support wheels 184 mounted on the driveshaft 178.

The intake end 174 of the main conveyor 156 is connected to the conveyor support 160 by a plurality of struts 186, each of which has an upper end pivotably connected to the main conveyor frame 172 and a lower end pivotably connected to the conveyor support 160. The pivotable connection between the main conveyor frame 172 and the struts 186 and between the struts 186 and the conveyor support 160 enables the intake end 174 of the main conveyor 156 to move between a first position, illustrated in FIG. 4, when the discharge end 176 of the main conveyor 156 is in a lowered position, and a second position, illustrated in FIG. 5, when the main conveyor 156 is somewhat raised, and a third position (not illustrated) when the main conveyor 156 is in a fully raised position. In other words, the intake end 174 of the main conveyor 156 moves from the right to the left in FIG. 4 as the main conveyor discharge end 176 rises.

Figure 1:
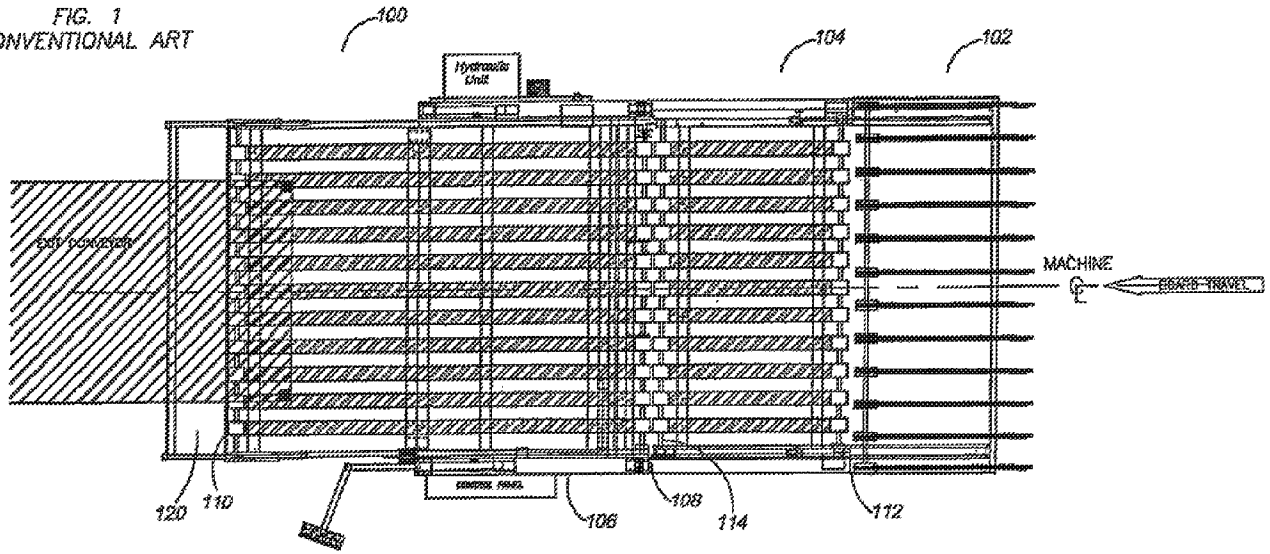
FIG. 1 CONVENTIONAL ART
FIG. 1 is a top plan view of a conventional sheet stacking apparatus including a layboy, a transfer conveyor and a main conveyor.
Figure 2:
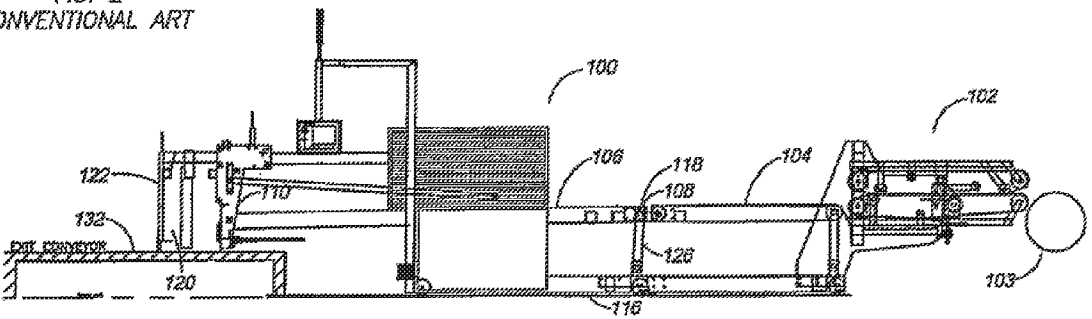
FIG. 2 CONVENTIONAL ART
FIG. 2 is a side elevational view of the sheet stacking apparatus of FIG. 1 in a lowered position.
Figure 3:
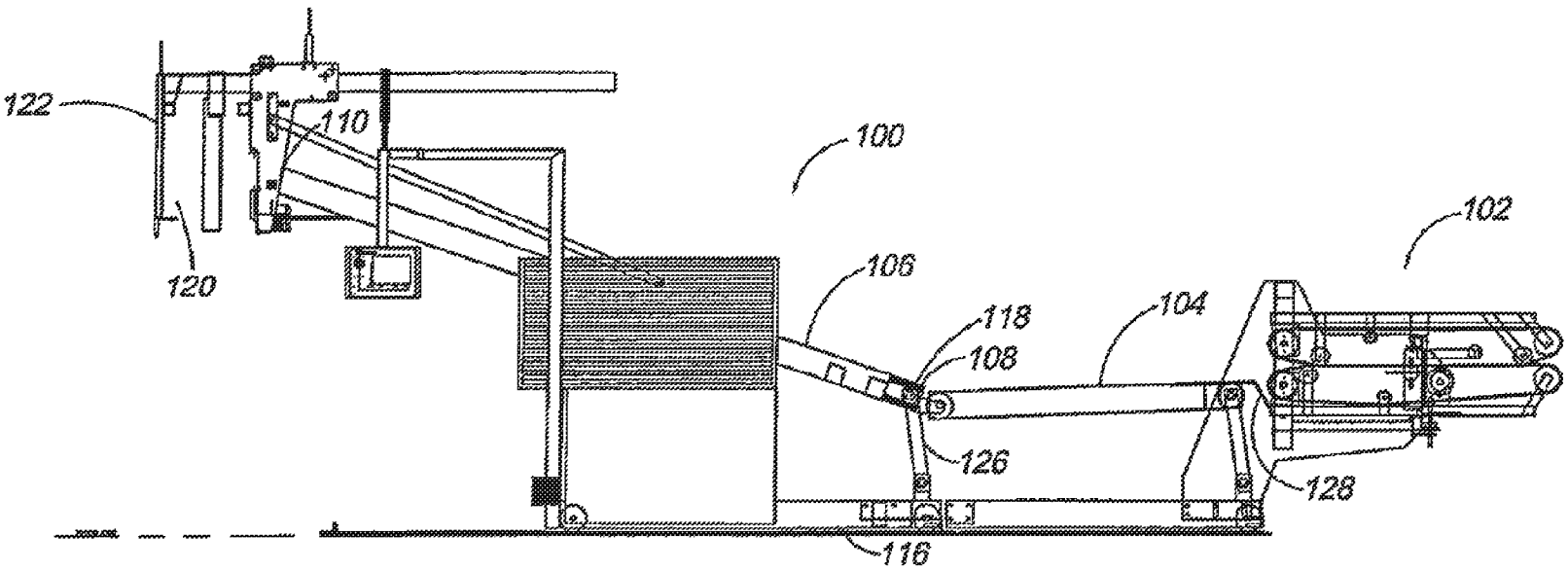
FIG. 3 CONVENTIONAL ART
FIG. 3 is a side elevational view of the sheet stacking apparatus of FIG. 1 in a raised position.

Because the discharge end 168 of the transfer conveyor 154 is fixed, it cannot move with the main conveyor intake end 174 as would the conventional transfer conveyor 104 illustrated in FIGS. 2 and 3. Therefore, if the variable length conveyor 158, described in more detail below, were not present, the distance between the discharge end 168 of the transfer conveyor 154 and the intake end 174 of the main conveyor 156 would grow when the discharge end 176 of the main conveyor 156 rises. This would adversely affect the movement of sheets from the transfer conveyor 154 to the main conveyor 156 and could lead to jams.

Beneficially, the variable length conveyor 158 spans the gap between the transfer conveyor 154 and the main conveyor 156 to provide a support surface for sheets of material moving downstream which support surface is present regardless of the position of the discharge end 176 of the main conveyor 156.

The variable length conveyor 158 comprises a plurality of drive wheels 190 mounted on the drive shaft 178 of the main conveyor 156 between the support wheels 184 which drive wheels 190 support a plurality of belts 192. (Alternately, the drive wheels 190 could be mounted on a separate shaft parallel to the drive shaft 178 which shaft is mechanically connected to the drive shaft 178 and/or to the drive 180). The drive wheels 190 are fixed against rotation relative to the drive shaft 178 so that the drive wheels 190 rotate with the driveshaft 178 to drive the plurality of belts 192. The plurality of belts 192 of the variable length conveyor 154 are caused to rotate by the drive 180 and the rotating drive shaft 178 so that the tops of the belts 192 mounted on the drive wheels 190 carry sheets toward the main conveyor 156.

The variable length conveyor 158 also includes an idler shaft 194 at the discharge end 168 of the transfer conveyor 154 which supports a plurality of idler wheels 196. The idler shaft 194 may be directly supported by a portion of a frame of the transfer conveyor 154, or, as illustrated, mounted to the conveyor support 160 or mounted in some other manner that holds the idler shaft 194 at a fixed location relative to the transfer conveyor discharge end 168. The idler shaft 194 may be fixedly mounted to side supports with the idler wheels 196 mounted for rotation relative to the idler shaft 194, or, alternately, the idler wheels 196 may be fixed to the idler shaft 194, and the idler shaft 194 itself may be journaled to side supports so that the idler shaft 194 and the idler wheels 196 rotate as a unit. The plurality of belts 192 extend from the drive wheels 190 of the driveshaft 178 to the idler wheels 196.

A transverse portion of the conveyor support 160 runs perpendicular to the downstream direction and beneath the gap between the transfer conveyor discharge end 168 and the main conveyor intake end 174, and a plurality of guide plates 198 are mounted thereto. Each of the guide plates 198 projects vertically and lies in a plane parallel to the downstream direction. Each of the guide plates 198 includes a curved slot 200 having a first curved guide wall 202 (first cam surface) and a second curved guide wall 203 (second cam surface) that extend upwardly and in the downstream direction.

Figure 10:
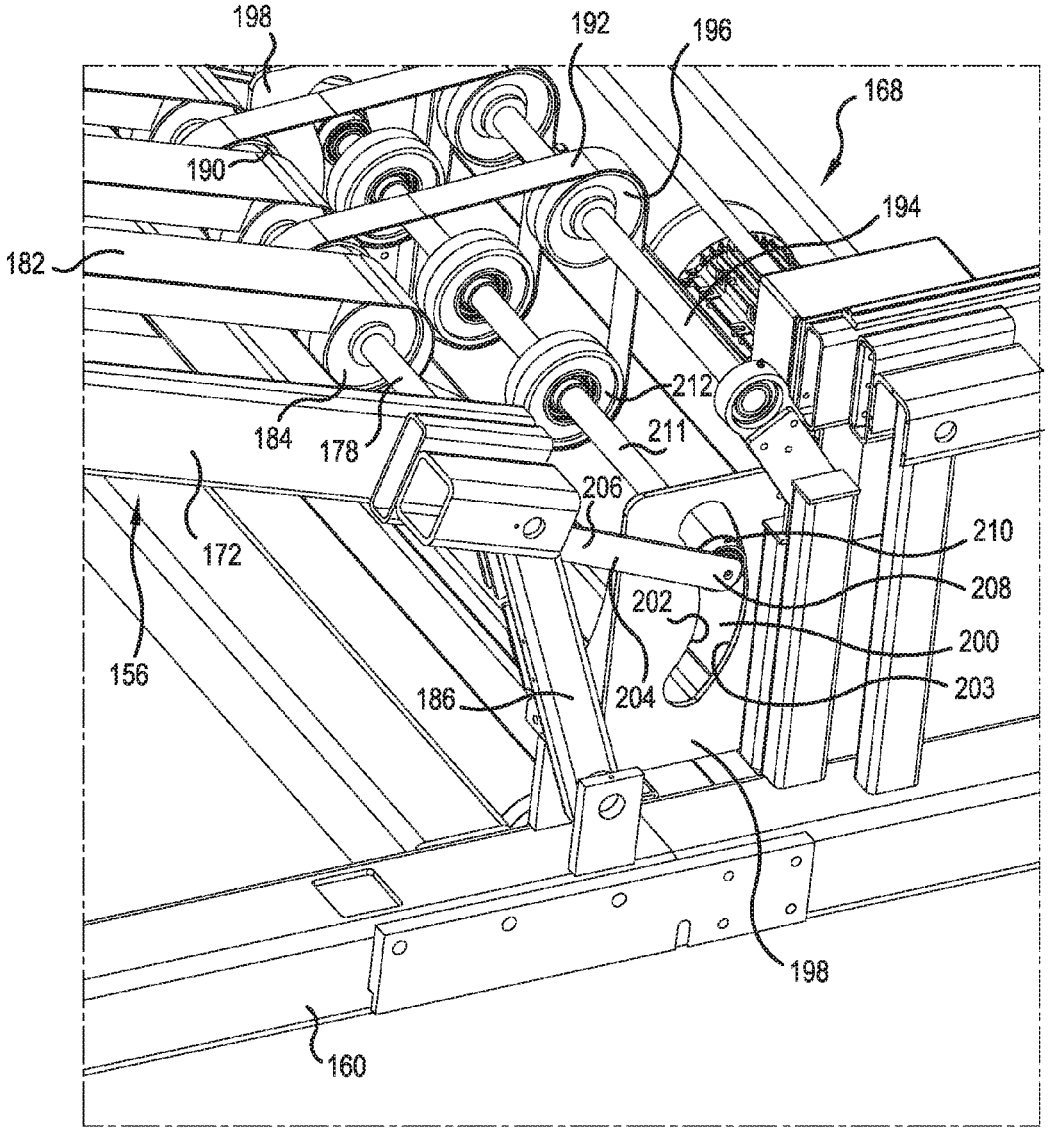
FIG. 10 is a first perspective view of the gap conveyor of FIG. 4.
Figure 11:
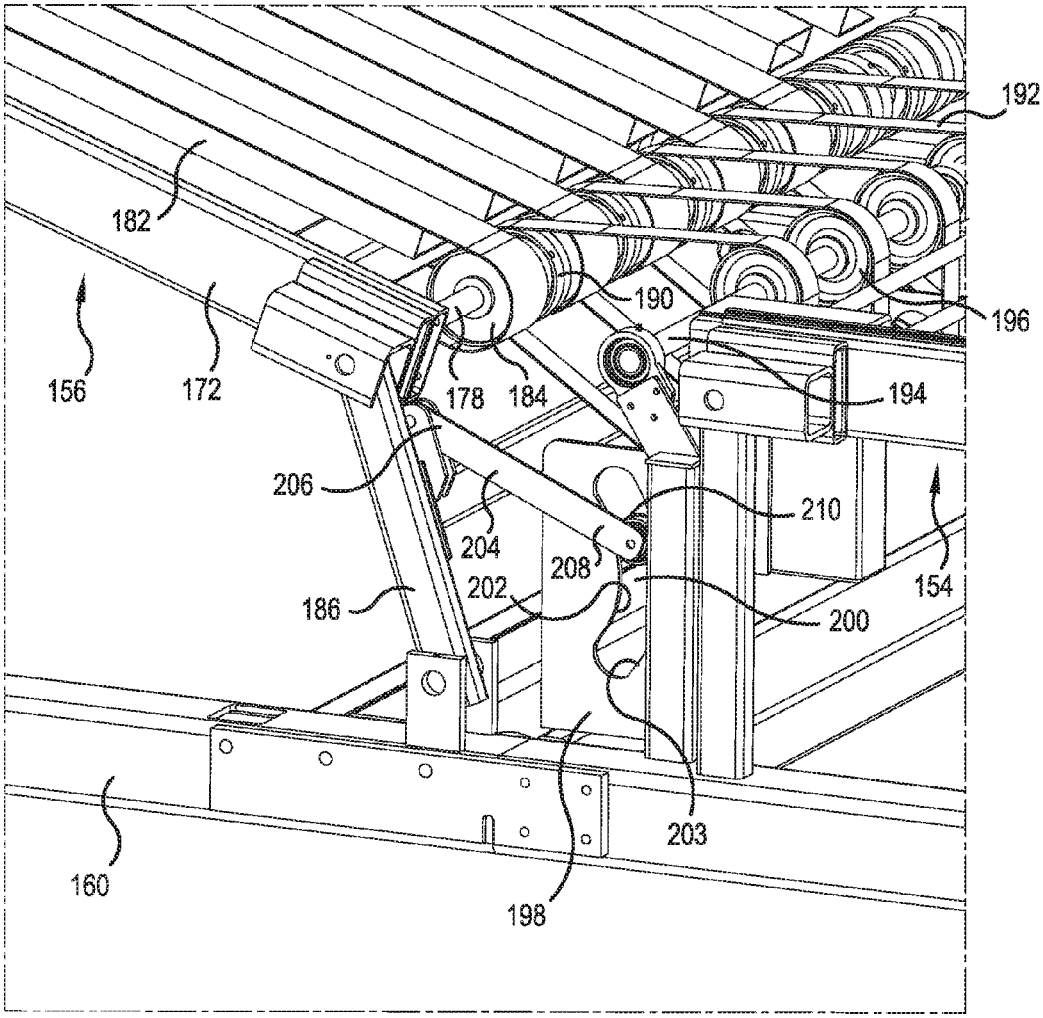
FIG. 11 is a second perspective view of the gap conveyor of FIG. 4.

As illustrated, for example in FIGS. 10 and 11, the variable length conveyor 158 further comprises a plurality of guide arms 204 each having a first end 206 pivotably mounted at or to the one of the struts 186 and a second end 208 near the curved slot 200 of one of the guide plates 198. The second end 208 of each guide arm 204 supports a cam roller 210. A shaft 211 (see FIG. 10) connecting the second ends 208 of the guide arms 204 supports a plurality of idler wheels 212. The cam roller 210 is mounted in the curved slot 200 between the first curved guide wall 202 and the second curved guide wall 203. The idler wheels 212 support the plurality of belts 192 of the variable length conveyor 158. The plurality of belts 192 thus extend around the triangles formed by each set of one drive wheel 190, one idler wheel 196 at the discharge end 168 of the transfer conveyor 158 and one idler wheel 212 at the second end of one of the guide arms 204.

The shape of the curved slots 200 is selected to ensure that the cam rollers 210 maintain a desired tension on the plurality of belts 192. There is very little clearance between the cam rollers 210 and the first and second curved guide walls 202, 203 of the curved slots 200. The relationship between the cam rollers 210 and the drive wheels 190 is therefore substantially fixed for any given spacing between the drive wheels 190 and the idler wheels 196. The interaction between the cam wheels 210 and the curved slots 200 thus maintains the desired tension on the plurality of belts 192 for all locations of the cam wheels 210 along the curved slots 200.

In operation, the rotary die cut machine 103 outputs cut sheets of material that are received into the intake end 162 of the layboy 152. The sheets exit the discharge end 164 of the layboy 152 and are received onto the intake end 166 of the transfer conveyor 154 and travel along the belts 170 of the transfer conveyor 154 to the transfer conveyor discharge end 168. After leaving the transfer conveyor 154, the sheets move onto the belts 192 of the variable length conveyor 158 and travel across the variable length conveyor 158 to the intake end of the main conveyor 174. The sheets than travel along the main conveyor 156 in a conventional manner and drop off the discharge end 176 of the main conveyor to form a stack.

This operation continues, and the main conveyor 156 remains in the generally horizontal position illustrated in FIG. 4 until the stack grows to a predetermined height. At that time, under the control of a conventional stacking apparatus controller (not illustrated), the discharge end 176 of the main conveyor 156 is raised gradually and reaches an intermediate position illustrated in FIG. 5.

Figure 5:
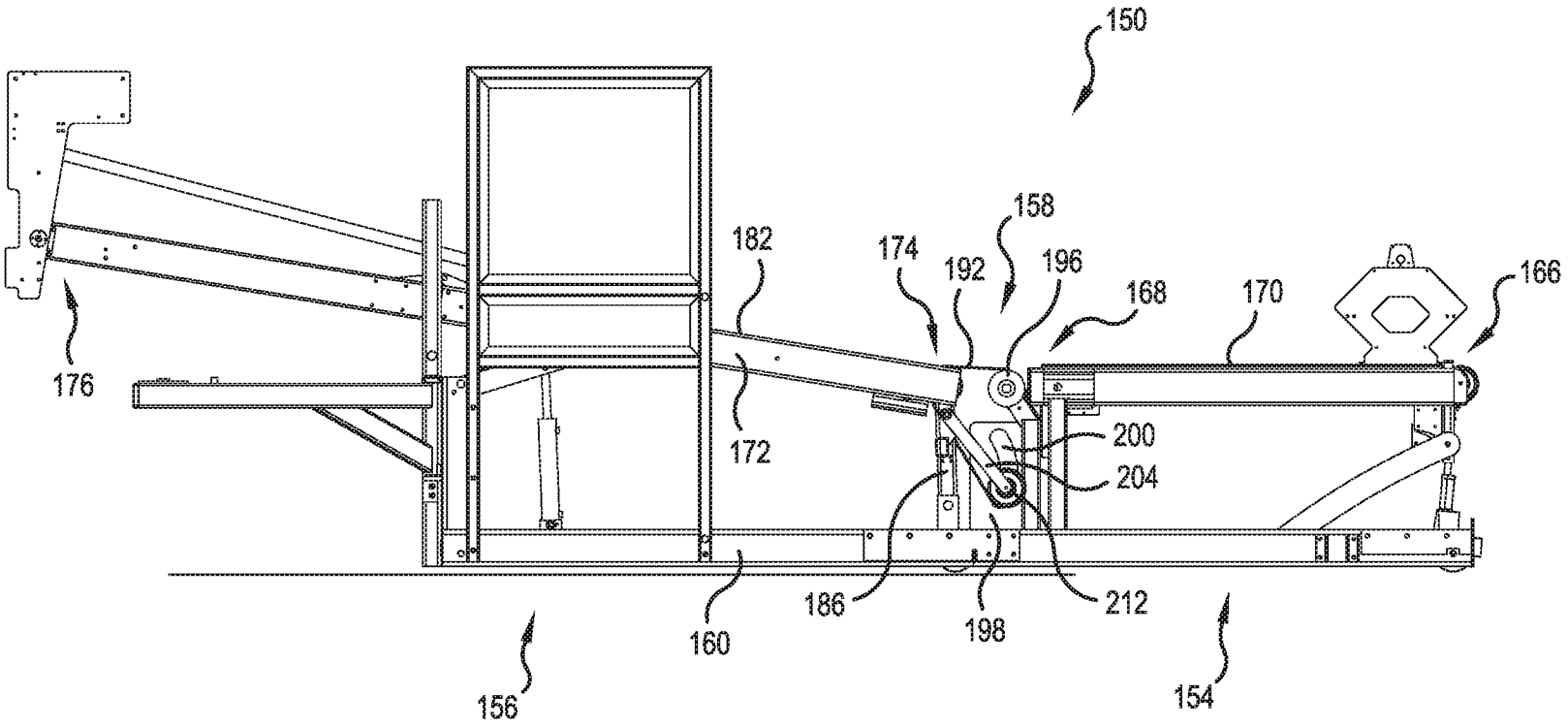
FIG. 5 is a side elevational view of the sheet stacking apparatus of FIG. 4 with the main conveyor in a slightly raised position.
Figure 7:
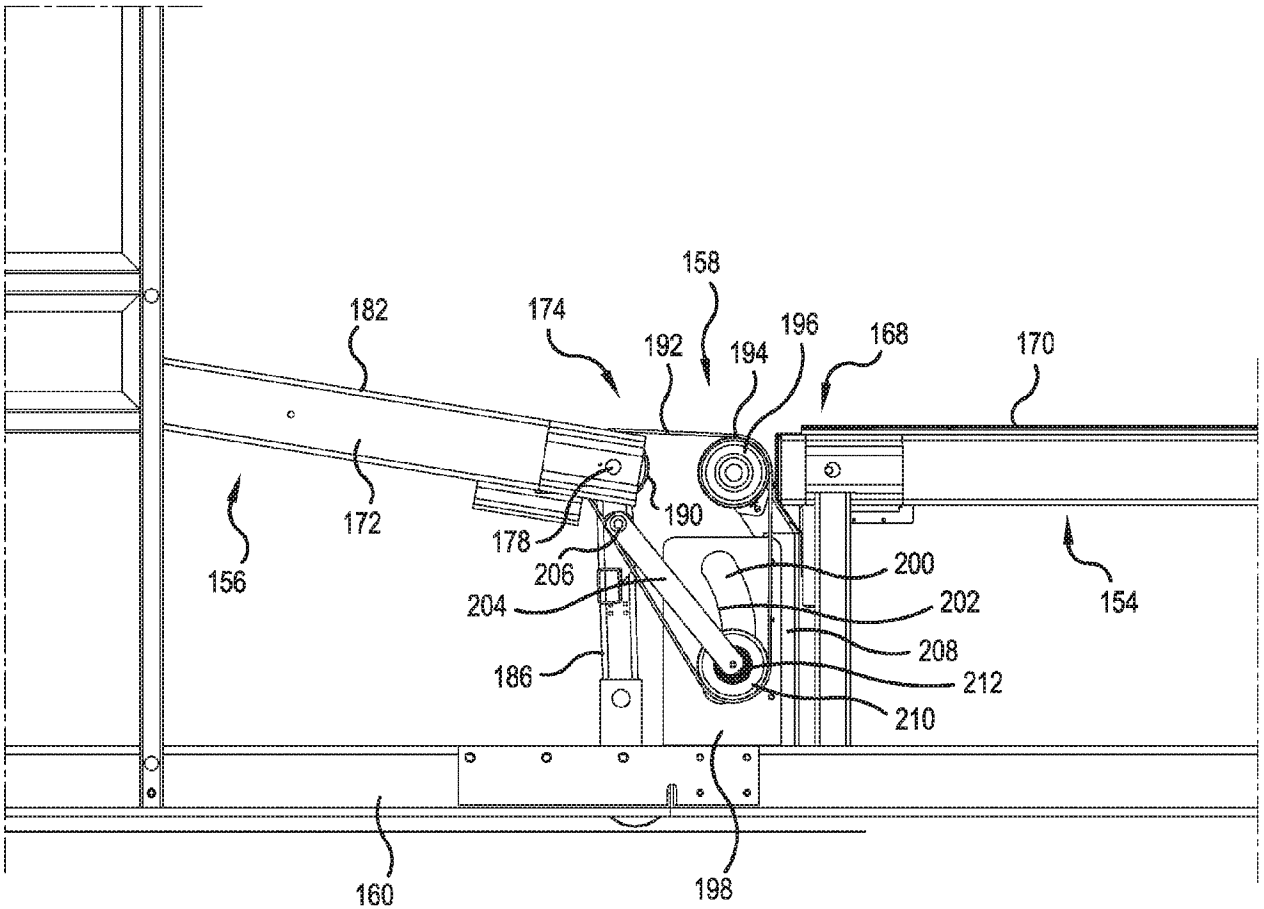
FIG. 7 is a detail view of the gap conveyor shown in FIG. 4 when the main conveyor is in the position of FIG. 5.

FIG. 7 is a detail view of the variable length conveyor 158 when the main conveyor 156 is in the position shown in FIG. 5. As will be appreciated from this figure, the generally vertical upward movement of the main conveyor discharge end 176 pulls the main conveyor intake end 174 toward the left in the figure, which movement is accommodated by the pivotal connections between the main conveyor frame 172 and the struts 186 and between the struts 186 and the conveyor support 160. This movement of the main conveyor intake end 174 pulls the drive shaft 178, which is attached to the frame 172 of the main conveyor 156, away from the idler shaft 194 and causes the top surface of the variable length conveyor 158 to lengthen. The tilting of the struts 186 also pulls the first end of the guide arm 204 away from the curved slot 200, which in turn causes the cam roller 210 roll along the first curved guide wall 202 of the curved slot 200. Because the top surface of the variable length conveyor 158 lengthens as the main conveyor discharge end 176 moves upwardly, sheets traversing the stacking apparatus 150 from the transfer conveyor 154 to the main conveyor 156 continue to travel smoothly without encountering gaps which could adversely affect sheet flow.

Figure 8:
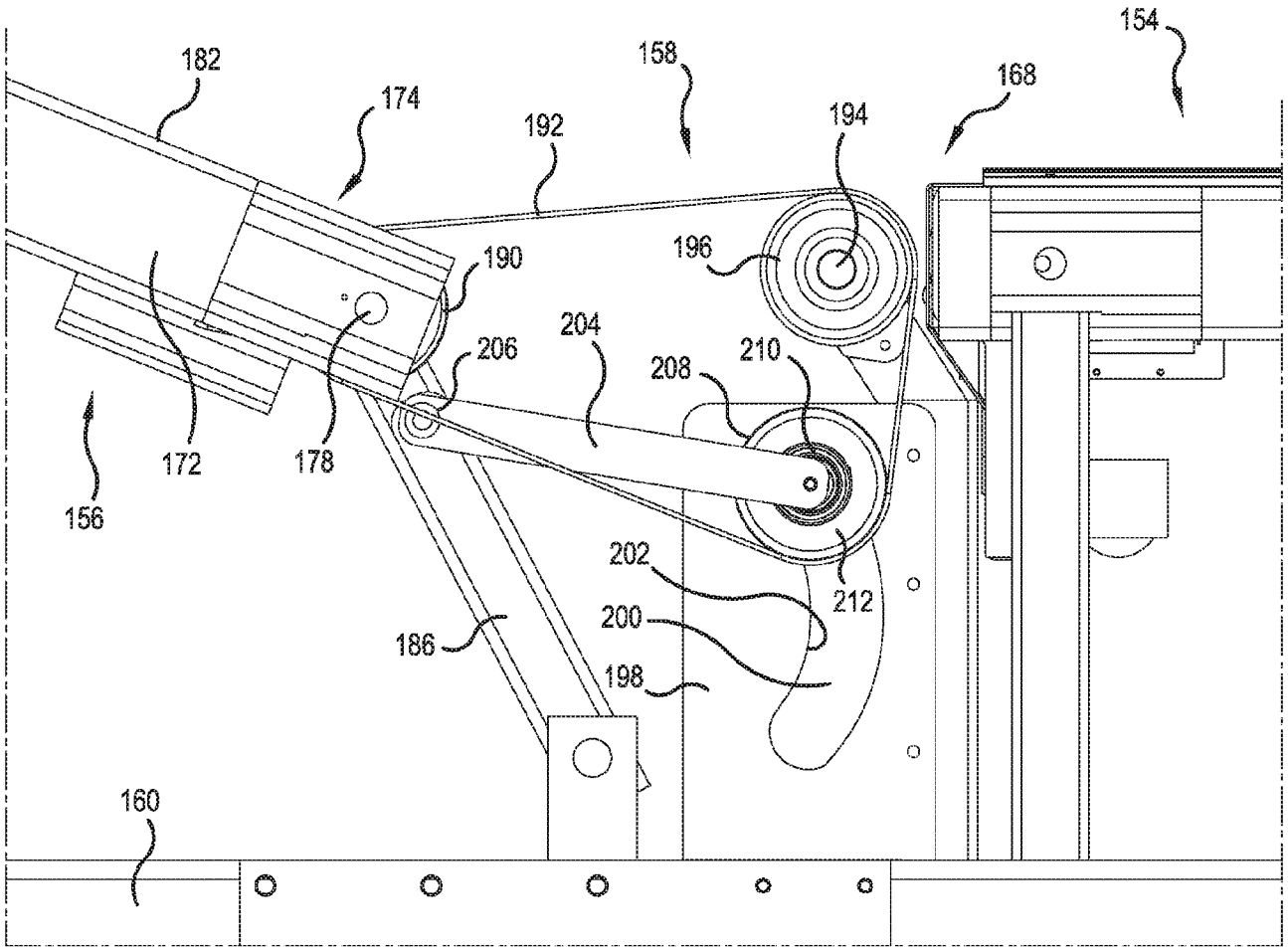
FIG. 8 is a detail view of the gap conveyor shown in FIG. 4 when the main conveyor is in a fully raised position.

FIG. 8 shows the variable length conveyor 158 when the discharge end 176 of the main conveyor 156 is fully raised. In this Figure, the struts 186 have tipped further to the left, pulling the first ends 206 of the guide arms 204 to the left and causing the cam rollers 210 to roll along the curved guide walls 202 to a location at or near the top of the curved slots 200, thus bringing the idler rollers 212 on the second ends 208 of the guide arms 204 closer to the idler wheels 196 on the idler shaft 194 and to the discharge end 168 of the transfer conveyor 154.

When the stacking system 150 finishes forming a given stack, the main conveyor discharge end 176 is returned to the position shown in FIG. 4. The cam rollers 210 travel back between the first curved guide walls 202 and the second curved guide walls 203 toward the bottom of the curved slots 200. Because the second curved guide walls 203 also control the positions of the cam rollers 210 as the intake end 174 of the main conveyor 156 moves closer to the discharge end 168 of the transfer conveyor 154, they force the bottom portions of the plurality of belts 192 downward and maintain tension on the plurality of belts 192 during the downward movement of the main conveyor 156.

The presence of the variable length conveyor 158 thus allows a gap between a transfer conveyor 154 and a main conveyor 156 to be filled when a transfer conveyor 154 having a fixed position discharge end 168 (fixed against movement in the sheet travel direction) is used.

The present invention has been described herein in terms of a preferred embodiment. However, modifications and additions to this disclosure will become apparent to persons of ordinary skill in the art upon a reading of the foregoing description. It is intended that all modifications and additions form a part of the present invention to the extent they fall within the scope of the several claims appended hereto.

What is claimed is:

1. A sheet stacking system for transporting sheets in a downstream direction and depositing the sheets in a stack, the system comprising:

a conveyor support, a layboy comprising opposed upper and lower conveyors configured to receive the sheets from a rotary die cut machine at a layboy intake end and output the sheets from a layboy discharge end, a transport conveyor downstream of the layboy and configured to receive the sheets from the layboy at a transport conveyor intake end and output the sheets from a transport conveyor discharge end, a main conveyor downstream of the transport conveyor, the main conveyor comprising a frame and being supported by the conveyor support and having a main conveyor intake end and a main conveyor discharge end, the main conveyor discharge end being movable between a lowered position and a raised position relative to the conveyor support, and the main conveyor intake end being configured to move from a first position relative to the conveyor support when the main conveyor discharge end is in the lowered position to second position relative to the conveyor support when the main conveyor discharge end is in the raised position, and a variable length conveyor between the transport conveyor discharge end and the main conveyor intake end, the variable length conveyor having a variable length conveyor intake end and a variable length conveyor discharge end connected to and movable with the main conveyor intake end and movable relative to the transport conveyor discharge end.

2. The sheet stacking system according to claim 1, wherein the variable length conveyor intake end is fixed relative to the conveyor support.

3. The sheet stacking system according to claim 2, wherein the transport conveyor discharge end is fixed relative to the conveyor support.

4. The sheet stacking system according to claim 1, wherein the transport conveyor discharge end is fixed relative to the conveyor support.

5. The sheet stacking system according to claim 1, wherein the main conveyor intake end is connected to the conveyor support by a strut having a first end and a second end, the first end of the strut being pivotably connected to the frame of the main conveyor and the second end of the strut being pivotably connected to the conveyor support.

6. The sheet stacking system according to claim 5, wherein the variable length conveyor includes a first wheel supported by the frame of the main conveyor, a second wheel fixed relative to the discharge end of the transport conveyor, a third wheel mounted at the end of an arm pivotably connected to the frame or to the strut and at least one belt mounted on the first, second and third wheels.

7. The sheet stacking system according to claim 6, including a plate having a curved wall fixedly mounted relative to the conveyor support, wherein the arm includes a roller configured to roll along the curved wall in response to the intake end of the main conveyor moving from the first position to the second position.

8. The sheet stacking system according to claim 7, wherein the curved wall comprise a side of a curved slot.

9. The sheet stacking system according to claim 6, wherein the main conveyor includes at least two main conveyor belts supported by at least one intake end wheel, and wherein the at least one belt of the variable length conveyor extends between the at least two main conveyor belts.

10. The sheet stacking system according to claim 6, wherein the first wheel of the variable length conveyor is mounted a shaft supporting drive wheels of the main conveyor.

11. A sheet stacking system for transporting sheets in a downstream direction and depositing the sheets in a stack, the system comprising:

a conveyor support, a transport conveyor having a transport conveyor intake end and a transport conveyor discharge end, the transport conveyor discharge end being fixed relative to the conveyor support, a main conveyor downstream of the transport conveyor, the main conveyor comprising a frame and being supported by the conveyor support and having a main conveyor intake end and a main conveyor discharge end, the main conveyor discharge end being movable between a lowered position and a raised position, and the main conveyor intake end being configured to move from a first position relative to the conveyor support when the main conveyor discharge end is in the lowered position to second position relative to the conveyor support when the main conveyor discharge end is in the raised position, and a variable length conveyor between the transport conveyor discharge end and the main conveyor intake end, the variable length conveyor having a variable length conveyor intake end and a variable length conveyor discharge end connected to and movable with the main conveyor intake end and movable relative to the transport conveyor discharge end, wherein the variable length conveyor includes a first wheel supported by the frame of the main conveyor, a second wheel fixed relative to the discharge end of the transport conveyor, a third wheel mounted at the end of an arm pivotably connected to the frame of the main conveyor and at least one belt mounted on the first, second and third wheels.

12. The sheet stacking system according to claim 11, wherein the main conveyor intake end is connected to the conveyor support by a strut having a first end and a second end, the first end of the strut being pivotably connected to the frame of the main conveyor and the second end of the strut being pivotably connected to the conveyor support.

13. The sheet stacking system according to claim 12, including a plate having a curved wall fixedly mounted relative to the conveyor support, wherein the arm includes a roller configured to roll along the curved wall in response to the intake end of the main conveyor moving from the first position to the second position.

14. The sheet stacking system according to claim 12, including a plate having a curved slot fixedly mounted relative to the conveyor support, wherein the arm includes a roller configured to roll along the curved slot in response to the intake end of the main conveyor moving from the first position to the second position.

15. The sheet stacking system according to claim 11 including a layboy comprising opposed upper and lower conveyors configured to receive the sheets from a rotary die cut machine at a layboy intake end and output the sheets to the transport conveyor intake end.

16. The sheet stacking system according to claim 11, wherein the main conveyor includes at least two main conveyor belts supported by an intake end shaft, and wherein the at least one belt of the variable length conveyor is configured to be driven by the intake end shaft.

17. A sheet stacking system for transporting sheets in a downstream direction and depositing the sheets in a stack, the system comprising:

a conveyor support, a layboy comprising opposed upper and lower conveyors configured to receive the sheets from a rotary die cut machine at a layboy intake end and output the sheets from a layboy discharge end, a transport conveyor downstream of the layboy and configured to receive the sheets from the layboy at a transport conveyor intake end and output the sheets from a transport conveyor discharge end, a main conveyor downstream of the transport conveyor, the main conveyor comprising a frame and being supported by the conveyor support and having a main conveyor intake end and a main conveyor discharge end, the main conveyor discharge end being movable between a lowered position and a raised position, and the main conveyor intake end being configured to move from a first position relative to the conveyor support when the main conveyor discharge end is in the lowered position to second position relative to the conveyor support when the main conveyor discharge end is in the raised position, and variable gap spanning means between the transport conveyor discharge end and the main conveyor intake end for carrying sheets from the transport conveyor to the main conveyor as a distance between the discharge end of the transport conveyor and the intake end of the main conveyor changes.

18. The sheet stacking system according to claim 17, wherein the variable gap spanning means includes a first wheel supported by the frame of the main conveyor, a second wheel fixed relative to the transport conveyor discharge end, a third wheel mounted at the end of an arm pivotably connected to the frame of the main conveyor and at least one belt mounted on the first, second and third wheels.

* * * * *